United States Patent [19]

Stiffler et al.

[11] Patent Number: 4,917,196

[45] Date of Patent: Apr. 17, 1990

[54] EXCAVATING TOOTH FOR AN EARTH AUGER

[75] Inventors: Stephen P. Stiffler, New Enterprise; Wayne H. Beach, Roaring Spring; Don C. Rowlett, Bedford; Steven D. Shirk, Altoona, all of Pa.

[73] Assignee: Kennametal Inc., Latrobe, Pa.

[21] Appl. No.: 394,045

[22] Filed: Aug. 15, 1989

[51] Int. Cl.[4] ..... E21B 10/44; E21B 10/58; E21B 10/62

[52] U.S. Cl. ..... 175/385; 175/394; 299/92

[58] Field of Search ..... 175/385, 394, 410, 412, 175/413; 299/91, 92, 93, 79, 89, 88

[56] References Cited

U.S. PATENT DOCUMENTS

| | | | |
|---|---|---|---|
| 2,780,439 | 2/1957 | Kandle | 175/394 X |
| 2,817,497 | 12/1957 | Lines | 175/413 X |
| 3,235,018 | 2/1966 | Troeppl | 175/413 X |
| 3,426,860 | 2/1969 | Petersen | 175/392 |
| 3,720,273 | 3/1973 | McKenry et al. | 175/335 |
| 3,737,199 | 6/1973 | Stephenson | 299/89 |
| 3,773,122 | 11/1973 | Chromy | 175/385 |
| 3,794,129 | 2/1974 | Taylor | 175/391 |
| 3,821,993 | 7/1974 | Kniff et al. | 175/292 |
| 3,830,321 | 8/1974 | McKenny et al. | 175/332 |
| 3,841,709 | 10/1974 | Kniff | 299/88 |
| 3,924,697 | 12/1975 | College | 175/382 |
| 4,046,207 | 9/1977 | Taylor | 175/391 |
| 4,214,617 | 7/1980 | McKenry | 175/385 X |
| 4,316,636 | 2/1982 | Taylor et al. | 299/92 |
| 4,326,592 | 4/1982 | Stephenson | 175/123 |
| 4,380,271 | 4/1983 | Baker et al. | 175/391 |
| 4,499,958 | 2/1985 | Radtke et al. | 175/329 |
| 4,660,660 | 4/1987 | Yuh | 175/410 |
| 4,666,714 | 5/1987 | Beach | 299/92 |
| 4,674,802 | 6/1987 | McKenna et al. | 299/79 |
| 4,830,123 | 5/1989 | Daly et al. | 175/410 X |

OTHER PUBLICATIONS

"Texoma Auger Tooling Products", brochure, Reedrill, Inc., Sherman, Tex.

*Primary Examiner*—Stephen J. Novosad
*Attorney, Agent, or Firm*—Larry R. Meenan

[57] ABSTRACT

An excavating tooth for use in connection with an earth drilling auger includes a main body portion terminating in a working end and a shank extending upwardly from the main body portion. A plurality of tungsten carbide inserts are embedded in the working end of the tooth and project outwardly therefrom. During drilling operations, the carbide inserts engage the earth and chisel away rock and other material which is subsequently conveyed to the surface by the fight structure of the auger. The inserts are inclined forwardly with respect to the plane of the shank to enable the inserts to withstand greater loads than before. In the preferred embodiment, the insert has a generally cylindrical proximal end embedded in the working end of the auger tooth and a distal end including forward and rearward inclined surfaces terminating in a transverse cutting edge.

15 Claims, 5 Drawing Sheets

EXCAVATING TOOTH FOR AN EARTH AUGER

FIELD OF THE INVENTION

The present invention relates generally to earth augers and more particularly to an excavating tooth for an earth auger adapted for boring holes in rock formations.

BACKGROUND OF THE INVENTION

Earth augers for boring holes in the earth are well known in the art and exemplified by U.S. Pat. No. 4,380,271. This patent describes an auger including a dual flight. Each flight has a leading edge which commences adjacent a pilot bit and a trailing edge which terminates adjacent a chuck. The flights concurrently spiral about a central shaft. A plurality of excavating teeth are arranged in step, radial fashion along the leading edges of the auger flights. During the drilling operations, the cutting teeth cut annular zones of increasing diameter as the auger progresses into the earth.

Typically, the excavating teeth used in connection with the earth auger include a main body portion terminating in a working end and a shank extending upwardly from the main body portion for insertion into the socket of a holder structure on the leading edge of the auger. The main body portion has a leading face which is relieved adjacent the working end to form a recess. One or more flat style inserts are disposed in the recess and are shaped to form a point.

While the excavating teeth described above, have served adequately for many years, one or more of the following problems have been frequently encountered:

(1) The tooth design does not provide adequate protection in high wear areas. Thus, during cutting operations, the body tends to wear excessively due to abrasive action with the rock formation.

(2) The large surface area of the carbide insert wearing against the rock face causes excessive loading which exceeds the rating of the carbide insert. The result is chipping and breaking of the insert rendering the tooth useless for further drilling.

(3) The large surface area and attack angle of the carbide insert creates excessive drag impeding the rate of penetration and reducing drilling performance.

Accordingly, some improvement in the design of excavating teeth is needed.

SUMMARY AND OBJECTS OF THE INVENTION

The present invention relates to an earth auger for boring holes in rock formations. The auger includes a dual flight. Each flight has a leading edge and spirals about the central shaft. A plurality of support blocks are fixed to the leading edge of each flight for receiving and holding excavating teeth. Preferably, the excavating teeth are arranged to cut within the distinct annular zones of increasing diameter from the innermost excavating tooth to the outermost excavating tooth.

Each of the excavating teeth includes a main body section terminating in a working end and a shank extending upwardly from the main body portion for insertion in the tooth support block. A plurality of chisel style carbide inserts are embedded in the working end of the excavating tooth and incline forwardly with respect to the plane of the tooth shank. This angle, called the angle of attack, is preferably between 20 degrees and 70 degrees. The angular disposition of the insert enables the insert to withstand higher loading than prior devices. Further, the chisel style inserts improves drilling efficiencies by reducing drag and increasing rate of penetration.

In a preferred embodiment of the invention, the insert comprises a generally cylindrical plug including a generally cylindrical proximal end and a distal end having forward and rearward inclined faces which converge to form a transverse cutting edge. The proximal end is embedded in a bevelled support surface and the insert is oriented so that the cutting edge is parallel to the support surface.

Based on the foregoing, it is apparent that the primary object of the present invention is to provide improvements in the design and performance of excavating teeth for earth drilling augers.

Another object of the invention is to provide a design for excavating teeth for an auger which greatly increases the rate of penetration of the auger.

A further object of the invention is to provide a design for excavating tooth for an auger which is capable of withstanding higher loadings than prior designs.

Another object of the present invention is to provide a design for an excavating tooth for an auger which is less susceptible to abrasive wear, chipping and breakage.

Other objects and advantages of the present invention will become apparent and obvious from a study of the following description and the accompanying drawings which are illustrative of such invention.

DETAILED DESCRIPTION OF THE INVENTION

Figure 1:
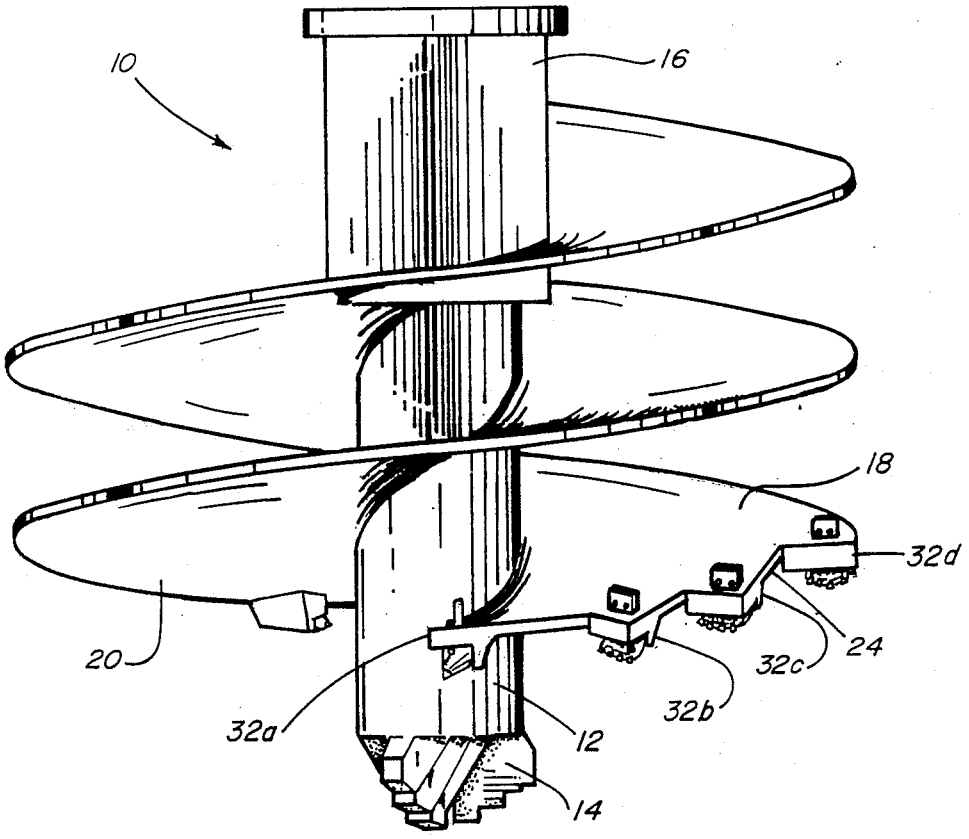
FIG. 1 is an elevation view of an earth drilling auger.

Referring now to FIG. 1 there is shown an auger 10 for boring holes in the earth. The auger 10 has a central shaft 12. A pilot bit 14 is affixed to the lower end of the shaft 12. The upper end of the shaft terminates in a chuck 16 for connecting the auger to a drive shaft (not shown).

The auger 10 further includes a pair of flight structures 18 and 20 in the form of spiraling webs. The flight structures 18 and 20 are rigidly fixed to the central shaft and extend radially therefrom. Each of the flight structures 18 and 20 includes a leading edge 24 which terminates adjacent to the pilot bit 14.

The leading edge 24 of the flight structure includes a plurality of support blocks 32 of conventional design. Each block 32 is formed with a tooth receiving pocket 34 extending through the block 32 for receiving the shank portions of the excavating teeth 40. The innermost support block **32*a* is disposed along the innermost edge of the flight structures adjacent to the pilot bit 14 and provides means for mounting the innermost excavating tooth. Support block 32*d* is located adjacent the outer rim of the flight structure while one or more intermediate support blocks 32b and 32c are disposed between the innermost and outermost support blocks. Excavating teeth 40 are received in the pockets of each of the support blocks 32 and are interchangeable between all of the tooth receiving pockets 34**.

Figure 2:
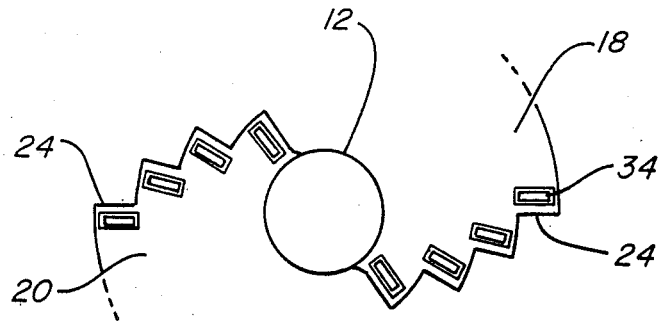
FIG. 2 is a partial plan view of the auger illustrating the leading edge of the flight structures.

As shown best in FIG. 2, the tooth holding blocks 32 are spaced along the leading edge 24 of each flight structure 18 and 20 in step radial fashion. Each of the excavating teeth 40 lie in a different radial plane with respect to the axial centerline of the shaft 12. Further, each of the excavating teeth 40 are radially spaced with respect to the centerline of the shaft 12 so that upon rotation of the auger, the excavating teeth 40 cut a series of concentric holes of increasing diameter.

Figure 4:
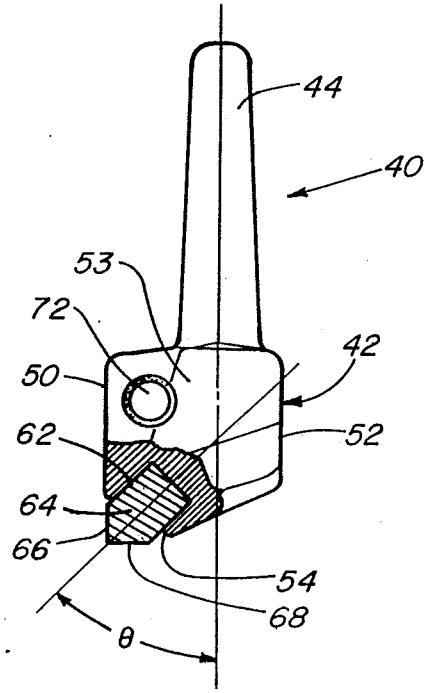
FIG. 4 is a side elevation of a digging tooth with a portion of the working end cut away.
Figure 3:
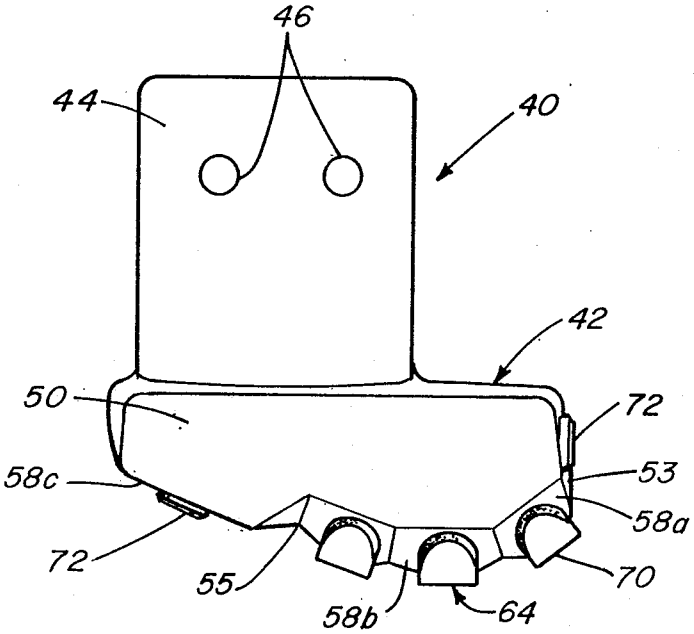
FIG. 3 is a front elevation of a digging tooth.
Figure 5:
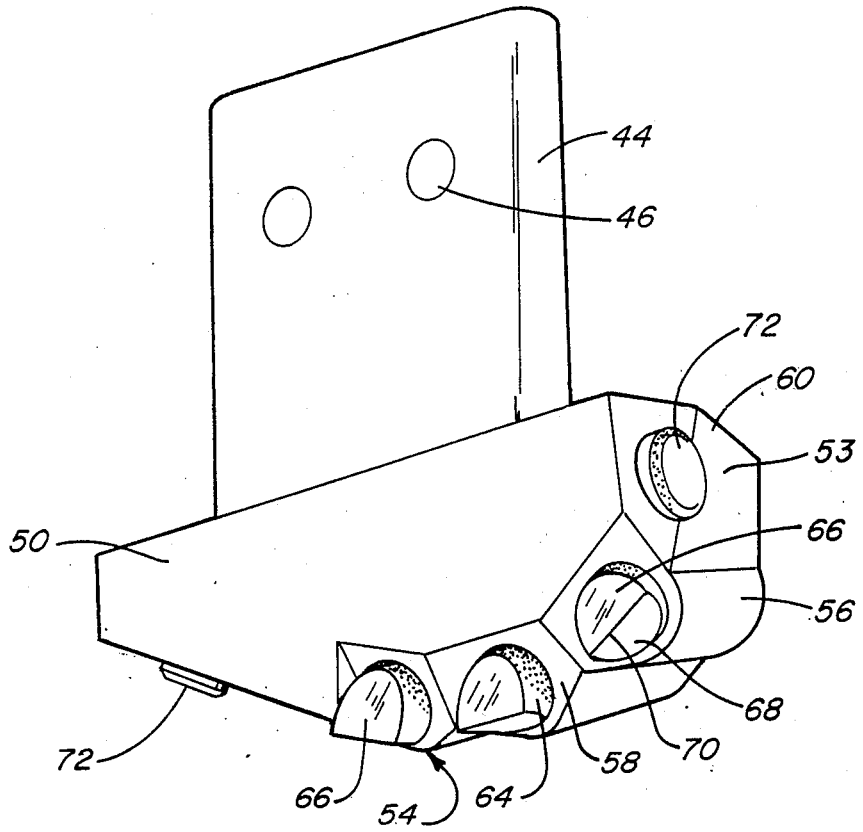
FIG. 5 is a perspective view of a digging tooth.

Referring now to FIGS. 3 through 5, the details of the excavating teeth 40 are illustrated. Each excavating tooth 40 includes a main body portion 42 with a shank 44 extending upwardly therefrom for insertion into the tooth receiving pocket 34 of a support block 32. The shank 44 has a rectangular shape so that when placed in a support block 32 having a pocket 34 of similar size and shape, the tooth 40 will not rotate in the block 32. The upper end of the shank 44 includes a pair of openings 46 for securing the tooth 40 in the support block 32 The shank 44 passes through the pocket 34 in the support blocks 32 so that the holes 46 therein clear the top surface of the flight structures 18 and 20. A cotter pin 48 or other suitable device can then be inserted through the holes 46 to retain the tooth 40 within the pocket 34.

The main body 42 of the tooth 40 includes a general planar leading face 50, a trailing face 52, a gauge side 53 and a working end portion 54. The working end portion 54 consists of a plurality of rounded, knuckle like projections 56. The knuckle-like projections 56 incline upwardly from the leading face 50 towards the trailing face 52 as best seen in FIG. 4 and are separated by recessed areas 55. The forward end of the rounded projections 56 terminate in a bevelled insert support surface 58 which is adjacent to the leading face 50 of the tooth 40. An insert cavity 62 is formed in the bevelled support surfaces 58 which are shown here to be cylindrical in shape. Each cavity 62 receives a digging insert 64 preferably formed of an extremely hard substance such as tungsten carbide.

The digging inserts 64 have a generally cylindrical proximal end which fits into the cavity 62 and are held in place by brazing or other suitable means. The distal end protrudes outwardly from the support surface 58 and includes forward and rearward inclined surfaces 66 and 68 which converge to provide a transverse cutting edge 70. Preferably, the cutting edges 70 of the inserts 64 are parallel to the support surface 58 in which the insert 64 is mounted.

Referring now to FIG. 4, it is seen that the inserts 64 are set into the cavity 62 so that the axis of the insert inclines forwardly from the plane of the tooth shank 44 at an angle of between 20 degrees and 70 degrees and preferably approximately 45 degrees. This angle, referred to as the angle of attack, enables the inserts to withstand higher loadings than prior devices.

In FIG. 3, it is seen that the carbide inserts 64 are arranged in pyramidal fashion so that the central insert 64 forms the point of the tooth. The remaining inserts 64 on either side are set progressively lower than the central insert and are angled away rom the central insert 64. Also, it is seen that the tooth 40 includes a flat wear insert 72 made of a hard wear resistent material such as tungsten carbide on the gauge side of the main body portion 42 to prevent abrasive wear at this point. A second wear insert 72 is placed on the working end 54 adjacent the inside of the tooth 40.

Figure 7:
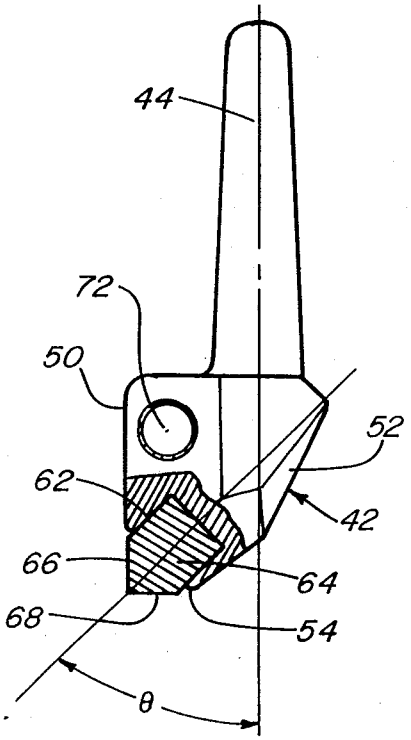
FIG. 7 is a side elevation of a second embodiment of a digging tooth with a portion of the working end cut away.
Figure 6:
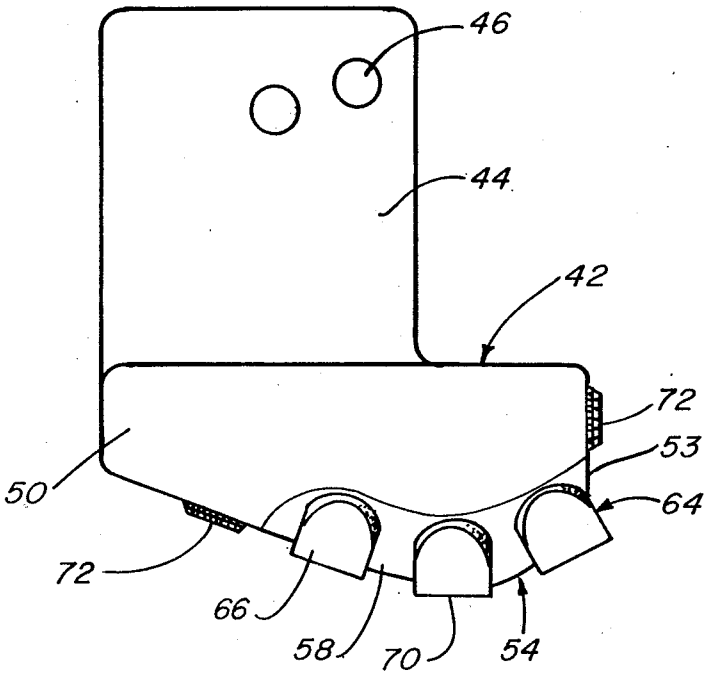
FIG. 6 is a front elevation of a second embodiment of a digging tooth.

In another embodiment of the invention, shown in FIGS. 6 and 7, the working end 54 of the main body section has been modified. In particular, instead of having distinct rounded projections, this embodiment has an arcuate shaped, beveled support surface 58. The support surface 58 is designed to hold three inserts 64 although the invention is not limited to that number. The center insert forms the point of the tooth while the inserts 64 on either side are set lower and at an angle with respect to the center insert. As in the previous embodiment, the inserts 64 are set into the working end 54 at an approximate 45 degree angle with respect to the plane of the tooth shank. (FIG. 7) Also, the transverse cutting edge 70 of each insert 64 is parallel to the support surface 58. Additionally, the second embodiment of the auger tooth includes two conical wear inserts 72; one on the gauge side of the main body section and one on the working end 54 adjacent the inside of the tooth.

The auger tooth 40 of the present invention has a number of distinct advantages over prior designs which utilize a flat-style insert. In prior designs, the area of highest wear and breakage occur at the gauge corner and the point. The present invention places a carbide, chisel-style insert 64 at each of these critical locations. The additional inserts 64 cover the remainder of the wear area. Further, by inclining the insert 64 forwardly with the respect to the plane of the tooth shank higher loads can be transferred through the insert 64 without breaking or chipping. The higher loads cause greater rock fracture and this increase drilling performance.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An earth drilling tool for boring holes in the earth comprising:

(a) an auger including:

(1) a central shaft terminating in a pilot bit at its lower end;

(2) a downwardly spiraling flight structure affixed to the shaft and extending generally radially therefrom, said flight structure terminating in a leading edge adjacent the pilot bit;

(3) a plurality of support blocks radially spaced along the leading edge of the flight structure which extend from an innermost position adjacent the central shaft to an outermost position adjacent to the outer rim of the flight structure, each support block having a tooth receiving pocket formed therein;

(b) a plurality of excavating teeth mounted within respective support blocks, each of the excavating teeth including:

(1) a main body portion having a leading face, a back face and a working end;

(2) a shank extending upwardly from the main body portion and insertable into the pocket of a corresponding support block; and (3) a plurality of digging inserts made of a hard wear resistant material embedded in the working end of the main body portion and projecting outwardly therefrom to engage the working medium during the drilling operation, wherein the axis of the inserts are inclined forwardly with respect to the plane of the shank of the excavating tooth to form an angle of attack of between 20 degrees and 70 degrees.

2. The earth drilling tool according to claim 1 wherein the angle of attack of the inserts is approximately 45 degrees.

3. The earth drilling tool according to claim 1 wherein the inserts comprise a generally cylindrical plug having forward and rearward inclined faces which converge to form a transverse cutting edge.

4. The earth drilling tool according to claim 3 wherein the forward inclined face of the insert is parallel to the plane of the shank of the excavating tooth.

5. The earth drilling tool according to claim 1 wherein each cutting tooth includes at least one wear insert embedded in the gauge side of the main body portion for reducing the amount of wear caused by abrasion of the main body portion against the medium being worked.

6. An excavating tooth for an earth auger comprising:

(a) a main body portion having a forward face, a back face, a gauge side and a working end;

(b) a shank extending upwardly from the main body portion and receivable in a support block of an auger; and (c) a plurality of digging inserts made of a hard, wear resistant material embedded in the working end of the main body section and projecting outwardly therefrom to engage the medium being worked, each of the inserts including a generally cylindrical proximal end and a distal end having forward and rearward inclined faces converging to form a transverse cutting edge, and wherein the axis of each of the inserts inclines forwardly with respect to the plane of the shank.

7. The digging tooth according to claim 6 wherein the angle between the plane of the shank and the axis of the inserts is between approximately 20 degrees and 70 degrees.

8. The excavating tooth according to claim 7 wherein the angle between the plane of the shank and the insert is approximately 45 degrees.

9. The excavating tooth according to claim 6 wherein the forward inclined face of the inserts are disposed in a plane parallel to the plane of the shank.

10. The excavating tooth according to claim 6 further including a wear insert made of a hard wear resistant material embedded in the gauge side of the main body portion for reducing abrasive wear.

11. An excavating tooth for an earth drilling auger comprising:

(a) a main body section having a leading face, a trailing face, gauge side and a working end, wherein the working end comprises a plurality of rounded projections each of which has an angularly oriented support surface adjacent the leading face of the main body section;

(b) a plurality of shallow cavities formed in respective support surfaces; and (c) a plurality of digging inserts made of a hard wear resistant material, each insert having a generally cylindrical proximal end inserted into a respective cavity in one of the support surfaces and a distal end having forward and rearward inclined faces converging to form a transverse cutting edge, wherein said cutting insert is adapted to engage the work medium during the drilling operation.

12. The excavating tooth according to claim 9 wherein the axis of each of the digging insets is inclined forwardly with respect to the plane of the shank so as to have an angle of attack of between 20 degrees and 70 degrees.

13. The excavating tooth according to claim 12 wherein the angle of attack is approximately 45 degrees.

14. The excavating tooth according to claim 10 wherein the forward inclined face of each of the digging inserts is disposed generally parallel to the plane of the shank.

15. The excavating tooth according to claim 11 further including at least one wear insert embedded in the gauge side of the main body section to prevent wear of the main body section.

* * * * *

US004917196B1

REEXAMINATION CERTIFICATE (1792nd)

United States Patent [19]

Stiffler et al.

[11] B1 4,917,196

[45] Certificate Issued Sep. 15, 1992

[54] EXCAVATING TOOTH FOR AN EARTH AUGER

[75] Inventors: Stephen P. Stiffler, New Enterprise; Wayne H. Beach, Roaring Spring; Don C. Rowlett, Bedford; Steven D. Shirk, Altoona, all of Pa.

[73] Assignee: Kennametal Inc., Latrobe, Pa.

Reexamination Request:
No. 90/002,430, Aug. 30, 1991

Reexamination Certificate for:

| | |
|---|---|
| Patent No.: | **4,917,196** |
| Issued: | **Apr. 17, 1990** |
| Appl. No.: | **394,045** |
| Filed: | **Aug. 15, 1989** |

[51] Int. Cl.[5] ..... E21B 10/44; E21B 10/58; E21B 10/62

[52] U.S. Cl. ..... 175/385; 175/394; 175/426

[58] Field of Search ..... 175/385, 394, 410, 412, 175/413, 391, 392, 310, 426, 427; 299/91, 92, 93, 79, 89, 88

[56] References Cited

U.S. PATENT DOCUMENTS

| | | | |
|---|---|---|---|
| 3,426,860 | 2/1969 | Petersen | 175/392 |
| 3,720,273 | 3/1973 | McKenry et al. | 175/335 |
| 3,737,199 | 6/1973 | Stephenson | 299/89 |
| 3,773,122 | 11/1973 | Chromy | 175/385 |
| 3,794,129 | 2/1974 | Taylor | 175/391 |
| 3,821,993 | 7/1974 | Kniff et al. | 175/292 |
| 3,830,321 | 8/1974 | McKenry et al. | 175/332 |
| 3,841,709 | 10/1974 | Kniff | 299/88 |
| 3,924,697 | 12/1975 | College | 175/382 |
| 4,046,207 | 9/1977 | Taylor | 175/391 |
| 4,214,617 | 7/1980 | McKenry | 175/385 X |
| 4,316,636 | 2/1982 | Taylor et al. | 299/92 |
| 4,326,592 | 4/1982 | Stephenson | 175/123 |
| 4,380,271 | 4/1983 | Baker et al. | 175/391 |
| 4,499,958 | 2/1985 | Radtke et al. | 175/329 |
| 4,660,660 | 4/1987 | Yuh | 175/410 |
| 4,666,214 | 5/1987 | Beach | 299/92 |
| 4,674,802 | 6/1987 | McKenna et al. | 299/79 |

FOREIGN PATENT DOCUMENTS

| | | |
|---|---|---|
| 1534067 | 6/1968 | France . |
| 2065199 | 6/1981 | United Kingdom . |

OTHER PUBLICATIONS

"Texoma Auger Tooling Products", brochure, Reedrill, Inc., Sherman, Tex.

"New Bit Designs Contribute to Lower-Cost Coal Cutting" from Coal Age by J. C. Leighton, pp. 108-110, May, 1958.

Pengo LD Series Catalog "Pengo Posthole Augers . . . ", Jun. 1979.

Pengo Drawing C3113 "Pengo 1336 Tooth", Dec. 1, 1971.

Pengo "Towner Wheel Trencher", 1973.

"Pengo 2070 Series Interchangeable Teeth", Aug. 1978.

"Pengo 1650 Series Teeth", May 1976.

"Pengo Teeth & Holders", pp. G-17 & G-20, 1973.

*Primary Examiner*—Stephen J. Novosad

[57] ABSTRACT

An excavating tooth for use in connection with an earth drilling auger includes a main body portion terminating in a working end and a shank extending upwardly from the main body portion. A plurality of tungsten carbide inserts are embedded in the working end of the tooth and project outwardly therefrom. During drilling operations, the carbide inserts engage the earth and chisel away rock and other material which is subsequently conveyed to the surface by the fight structure of the auger. The inserts are inclined forwardly with respect to the plane of the shank to enable the inserts to withstand greater loads than before. In the preferred embodiment, the insert has a generally cylindrical proximal end embedded in the working end of the auger tooth and a distal end including forward and rearward inclined surfaces terminating in a transverse cutting edge.

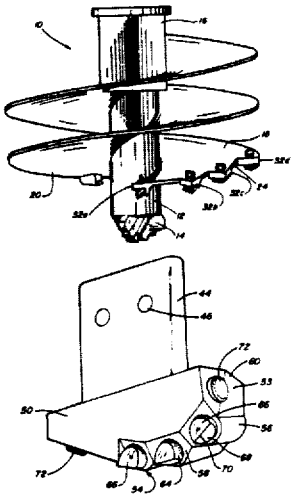

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 11 and 15 is confirmed.

Claims 6 and 10 are cancelled.

Claims 1, 4, 7, 9 and 14 are determined to be patentable as amended.

Claims 2, 3, 5, 8, 12 and 13, dependent on an amended claim, are determined to be patentable.

1. An earth drilling tool for boring holes in the earth comprising:

(a) an auger including:

(1) a central shaft terminating in a pilot bit at its lower end;

(2) a downwardly spiraling flight structure affixed to the shaft and extending generally radially therefrom, said flight structure terminating in a leading edge adjacent the pilot bit;

(3) a plurality of support blocks radially spaced along the leading edge of the flight structure which extend from an innermost position adjacent the central shaft to an outermost position adjacent to the outer rim of the flight structure, each support block having a tooth receiving pocket formed therein;

(b) a plurality of excavating teeth mounted within respective support blocks, each of the excavating teeth including:

(1) a main body portion having a leading face, a back face and a working end;

(2) a shank extending upwardly from the main body portion and insertable into the pocket of a corresponding support block; and (3) a plurality of digging inserts made of a hard wear resistent material embedded in the working end of the main body portion and projecting outwardly therefrom to engage the working medium during the drilling operation, wherein [the axis of the inserts are inclined forwardly with respect to the plane of the shank of the excavating tooth to form] an angle of attack of between 20 degrees and 70 degrees *is formed by the forwardly inclined axis of the inserts with respect to the plane of the shank of the excavating tooth.*

4. [The earth drilling tool according to claim 3 wherein] *An earth drilling tool for boring holes in the earth comprising:*

*(a) an auger including:*

*(1) a central shaft terminating in a pilot bit at its lower end;*

*(2) a downwardly spiraling flight structure affixed to the shaft and extending generally radially therefrom, said flight structure terminating in a leading edge adjacent the pilot bit;*

*(3) a plurality of support blocks radially spaced along the leading edge of the flight structure which extend from an innermost position adjacent the central shaft to an outermost position adjacent to the outer rim of the flight structure, each support block having a tooth receiving pocket formed therein;*

*(b) a plurality of excavating teeth mounted within respective support blocks, each of the excavating teeth including:*

*(1) a main body portion having a leading face, a back face and a working end;*

*(2) a shank extending upwardly from the main body portion and insertable into the pocket of a corresponding support block; and*

*(3) a plurality of digging inserts made of a hard wear resistant material embedded in the working end of the main body portion and projecting outwardly therefrom to engage the working medium during the drilling operation, wherein an angle of attack of between 20 degrees and 70 degrees is formed by the forwardly inclined axis of the inserts with respect to the plane of the shank of the excavating tooth and the inserts comprise a generally cylindrical plug having forward and rearward inclined faces which converge to form a transverse cutting edge and* the forward inclined face of the insert is parallel to the plane of the shank of the excavating tooth.

7. [The digging tooth according to claim 6 wherein] *An excavating tooth for an earth auger comprising:*

*(a) a main body portion having a forward face, a back face, a gauge side and a working end;*

*(b) a shank extending upwardly from the main body portion and receivable in a support block of an auger; and*

*(c) a plurality of digging inserts made of a hard, wear resistant material embedded in the working end of the main body section and projecting outwardly therefrom to engage the medium being worked, each of the inserts including a generally cylindrical proximal end and a distal end having forward and rearward inclined faces converging to form a transverse cutting edge, and wherein the axis of each of the inserts inclines forwardly with respect to the plane of the shank and* the angle between the plane of the shank and the axis of the inserts is between approximately 20 degrees and 70 degrees.

9. [The excavating tooth according to claim 6 wherein] *An excavating tooth for an earth auger comprising:*

*(a) a main body portion having a forward face, a back face, a gauge side and a working end;*

*(b) a shank extending upwardly from the main body portion and receivable in a support block of an auger; and*

*(c) a plurality of digging inserts made of a hard, wear resistant material embedded in the working end of the main body section and projecting outwardly therefrom to engage the medium being worked, each of the inserts including a generally cylindrical proximal end and a distal end having forward and rearward inclined faces converging to form a transverse cutting edge, and wherein the axis of each of the inserts inclines forwardly with respect to the plane of the shank and* the forward inclined face of the inserts are disposed in a plane parallel to the plane of the shank.

14. [The excavating tooth according to claim 10] *An excavating tooth for an earth auger comprising:*

(*a*) *a main body portion having a forward face, a back face, a gauge side and a working end;*

(*b*) *a shank extending upwardly from the main body portion and receivable in a support block of an auger; and*

(*c*) *a plurality of digging inserts made of a hard, wear resistant material embedded in the working end of the main body section and projecting and projecting outwardly therefrom to engage the medium being worked, each of the inserts including a generally cylindrical proximal end and a distal end having forward and rearward inclined faces converging to form a transverse cutting edge, and wherein the axis of each of the inserts inclines forwardly with respect to the plane of the shank further including a wear insert made of a hard wear resistant material embedded in the gauge side of the main body portion for reducing abrasive wear* wherein the forward inclined face of each of the digging inserts is disposed generally parallel to the plane of the shank.

* * * * *